US006520388B1

(12) United States Patent
Gavrilenco et al.

(10) Patent No.: US 6,520,388 B1
(45) Date of Patent: Feb. 18, 2003

(54) CASTING FURNACE AND METHOD FOR CONTINUOUS CASTING OF MOLTEN MAGNESIUM

(75) Inventors: Vladimir Gavrilenco, Montreal (CA); Roger C. Urquhart, Pointe Claire (CA); Roman Deshko, Toronto (CA); Allen H. Schultz, East Amherst, NY (US)

(73) Assignee: Hatch Associates Ltd., Mississauga ( * ) Notice: Subject to any disclaimer, the term of this patent is extended or adjusted under 35 U.S.C. 154(b) by 2 days.

(21) Appl. No.: 09/703,371

(22) Filed: Oct. 31, 2000

(51) Int. Cl.[7] ..... B22D 37/00

(52) U.S. Cl. ..... 222/590; 222/594; 266/231; 164/281

(58) Field of Search ..... 266/231, 200; 222/590, 594; 164/281, 81

(56) References Cited

U.S. PATENT DOCUMENTS

| | | | | |
|---|---|---|---|---|
| 2,621,916 A | | 12/1952 | Murphy | |
| 3,767,382 A | * | 10/1973 | Bruno et al. | 266/232 |
| 3,841,387 A | * | 10/1974 | Martin | 164/81 |
| 3,845,811 A | * | 11/1974 | Martin | 164/281 |
| 3,882,261 A | | 5/1975 | Kosarev et al. | |
| 4,290,804 A | | 9/1981 | Avery | |
| 4,372,542 A | | 2/1983 | Chia | |
| 4,373,704 A | | 2/1983 | Pelton | |
| 4,390,364 A | | 6/1983 | Yu | |
| 4,456,231 A | | 6/1984 | Bergsoe | |
| 4,468,164 A | | 8/1984 | Dunn et al. | |
| 4,645,186 A | | 2/1987 | Hanniala | |
| 5,908,488 A | | 6/1999 | Schröder et al. | |
| 5,925,165 A | | 7/1999 | Pflügl et al. | |
| 6,010,552 A | | 1/2000 | Gasperetti et al. | |

FOREIGN PATENT DOCUMENTS

| | | |
|---|---|---|
| CA | 1179150 | 12/1984 |

* cited by examiner

*Primary Examiner*—Scott Kastler
(74) *Attorney, Agent, or Firm*—Kirkpatrick & Lockhart LLP

(57) ABSTRACT

A casting furnace for continuous casting of magnesium comprises a furnace body divided into at least two compartments by at least one vertical weir. Inside each compartment, an upper layer of molten magnesium is in contact with a lower layer of a liquid heating medium, preferably a molten salt. The top of the weir is situated below a maximum level of the molten magnesium in the furnace. The weir is free of openings between its top and the magnesium/salt interface. The molten magnesium from primary (electrolytic) production or an alloy preparation furnace is introduced into a feed compartment of the furnace through a discharge pipe having means to direct the magnesium horizontally along the magnesium/salt interface, thereby minimizing intermixing of the magnesium and salt layer. The weir(s) separating the compartments minimize the effects of turbulence on the magnesium being pumped from the extraction compartment and also assist in minimizing the intermixing of the magnesium and salt layers, thereby providing a more energy efficient casting process capable of producing high quality castings.

14 Claims, 2 Drawing Sheets

CASTING FURNACE AND METHOD FOR CONTINUOUS CASTING OF MOLTEN MAGNESIUM

FIELD OF THE INVENTION

This invention relates to casting of metals, and more specifically to a casting furnace and a method for continuous casting of magnesium and magnesium alloys.

BACKGROUND OF THE INVENTION

The following steps are involved in conventional processes for the preparation and casting of magnesium and magnesium alloys.

1. Pure Magnesium Refining

This step is used to purify magnesium which has been produced by an electrolytic process and typically contains a number of impurities. The terms "pure magnesium" and "primary magnesium" are usually used to describe unalloyed, unrefined magnesium at it comes to the foundry from the electrolytic process. Refined magnesium is also referred to as "purified magnesium" by the industry. Refining of pure magnesium may be performed in a continuous refining furnace as disclosed in Canadian Patent No. 1,179,150 (Wallevik et al.) or Canadian Patent No. 1,022,978 (Kosarev et al.). Refining furnaces are divided into a number of compartments, each of which contains a layer of molten magnesium in contact with an underlying layer of molten salt. Impurities separate into the salt layer and settle to the bottom as sludge. The partition walls separating adjacent compartments are provided with passages through which the magnesium passes, such that the purity of the magnesium becomes progressively higher as it magnesium passes through the successive compartments. In such furnaces, mixing of the magnesium layer and the underlying salt layer is encouraged to maximize the purification of the raw magnesium. To this end, the furnace disclosed in the Wallevik et al. patent includes downwardly directed passages in the partition walls which force the magnesium exiting each compartment downwardly to mix with the salt layer in the next compartment. Where no alloying elements are to be added, the refined magnesium may be pumped directly from the refining furnace to the casting line.

2. Alloy Preparation 2.1 Primary Magnesium Alloys

This step is conducted in an alloy preparation furnace. The capacity of the furnace is limited by several factors, including structural limitations, heat distribution and melt homogenization. The most economical furnace metal holding capacity is about 4 to 8 tons. Alloying is necessarily a batch process in which primary magnesium is charged to the furnace, and then alloying elements are added and the mixture is agitated. During melt agitation, manganese chloride is added for iron removal and flux is added for oxide removal. Agitation is then discontinued and the impurities are allowed to settle out of the melt. Batch analysis is then conducted and after the alloy is acceptable, it is ready for casting, with no further refining being required.

2.2 Recycled Magnesium Alloys

Recycled magnesium alloys are usually produced from magnesium scrap. The recycling process typically involves scrap inspection, sizing, pre-heating, melting, refining and casting. The melting and refining operations may utilize either flux based or fluxless technologies. Some melting and refining operations utilize blending of the recycled alloy with primary magnesium alloy produced from electrolytic magnesium metal or from magnesium metal produced by thermal processes. The refining operation is utilized to remove oxides and other non-metallic inclusions from the recycled metal. The recycling process may also include adjustment of chemical composition of the alloy.

3. Alloy Casting

The alloy is transferred from the alloy preparation furnace to a crucible casting furnace where it is typically cast into ingots. As with the alloying furnace, the size of the casting furnace is limited for structural and other reasons, and typically provides little or no buffer capacity. Accordingly, alloy casting is essentially a batch process.

Attempts to continuously transfer the alloy from the alloy preparation furnace to the casting furnace have in the past been unsuccessful, partly for the reason that turbulence created by transferring the molten alloy has a detrimental effect on the quality of the ingots. Accordingly, casting of magnesium alloys is essentially a batch process which is characterized by low productivity and high energy consumption.

Continuous refining furnaces such as that described by the above-mentioned Wallevik et al. patent have also been employed as casting furnaces for pure or alloy magnesium. Although such furnaces provide buffer capacity and therefore allow continuous casting of magnesium, the use of such furnaces for casting is inefficient for a number of reasons. Firstly, such refining furnaces are typically of a large size, capable of storing 25 to 35 tons of magnesium, whereas a typical casting line typically consumes magnesium or magnesium alloy at a rate of about 2 to 5 tons/hr. Thus, the use of such furnaces for casting requires the accumulation and heating of excessive amounts of magnesium. Secondly, when such furnaces are used for casting alloy magnesium, the molten metal fed to the furnace is already refined, and therefore subjecting it to further refining is unnecessary and wasteful.

Therefore, the need exist for a continuous casting furnace which can more efficiently cast pure magnesium and magnesium alloys.

SUMMARY OF THE INVENTION

The present invention overcomes the above-mentioned problems of the prior art by providing a method and a casting furnace for continuous casting of molten magnesium and magnesium alloys (primary and recycled). The casting furnace according to the invention comprises at least two compartments, with pure magnesium or magnesium alloy being charged into a feed compartment, and being removed for casting from an extraction compartment located downstream of the feed compartment. In each compartment, a layer of molten magnesium is in contact with a liquid heating medium, preferably a molten salt layer. However, to minimize mixing between the magnesium and molten salt layers, the present invention provides means for directing the magnesium along the magnesium/salt interface so as to minimize further mixing of the magnesium with the molten salt.

Furthermore, the compartments of the furnace according to the invention are separated by at least one vertical weir, over which the molten magnesium flows from the feed compartment where it is introduced to the extraction compartment from which it is removed. The weir is essentially free of openings between its top and the magnesium/salt interface, thereby further minimizing mixing of the two layers. Also, the weir isolates the extraction compartment from turbulence caused by introduction of the magnesium into the feed compartment.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
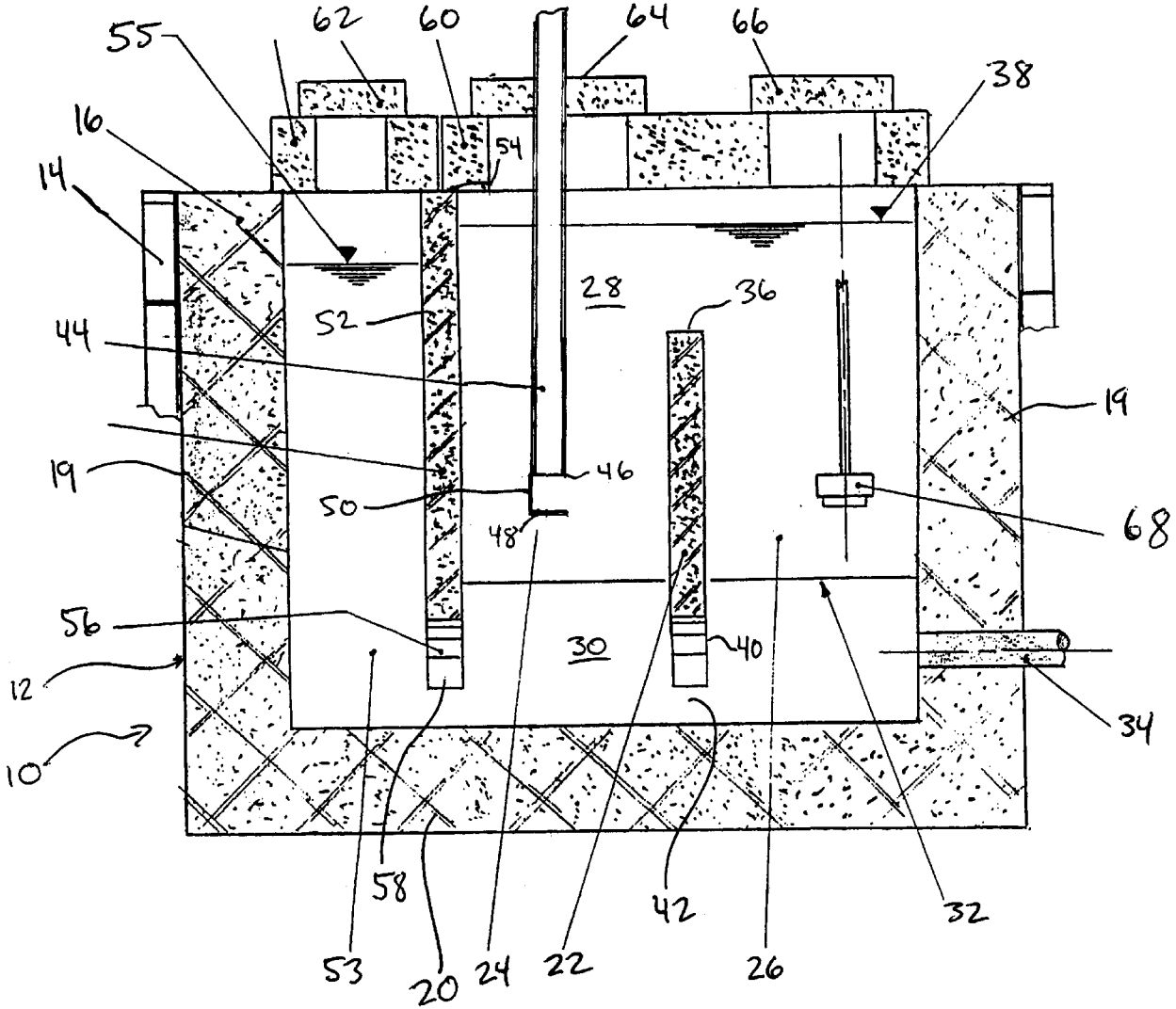
FIG. 1 is a vertical cross section taken along the axis of a preferred continuous casting furnace according to the present invention.
Figure 2:
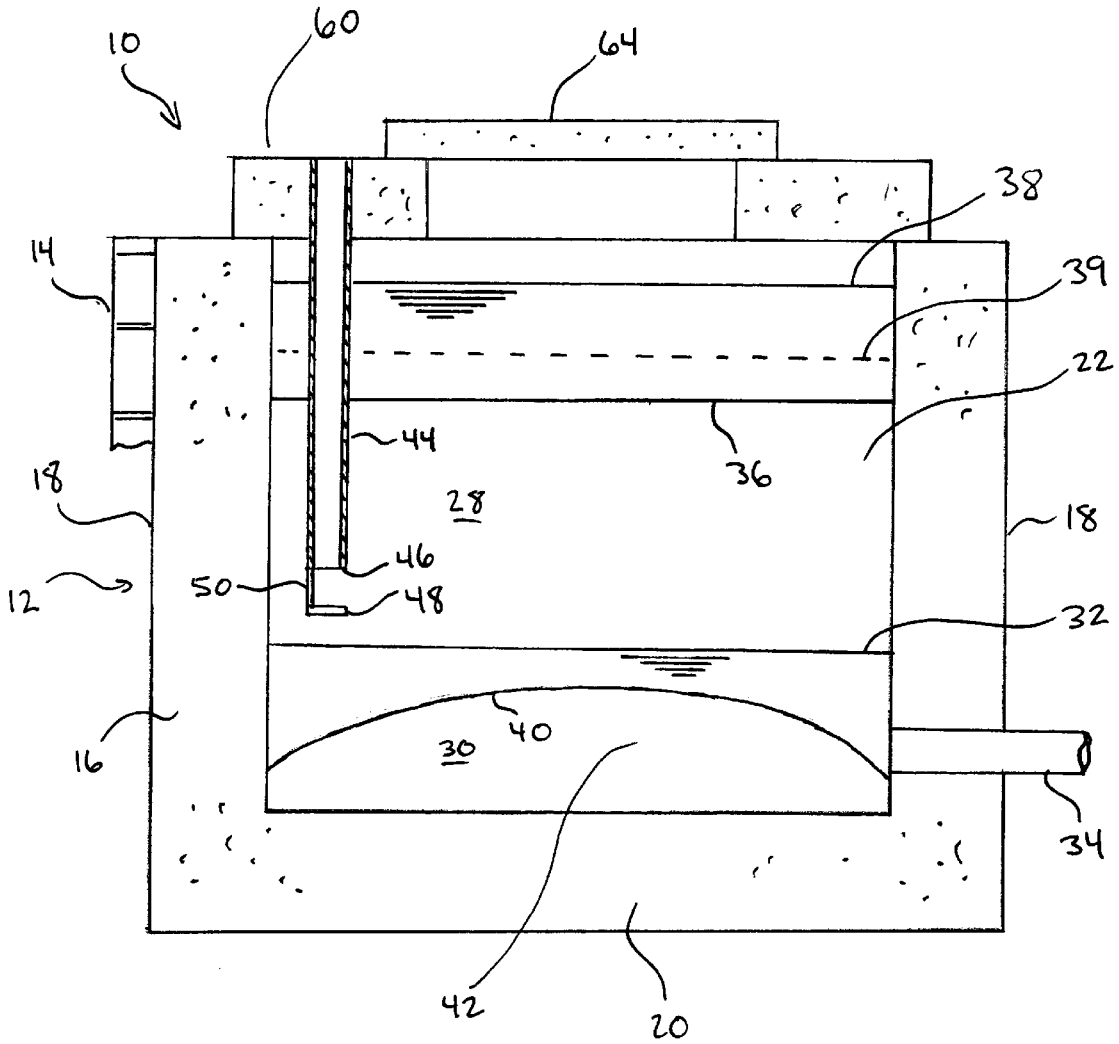
FIG. 2 is a vertical cross section taken perpendicular to the axis of the furnace of FIG. 1.

FIG. 1 shows a sectional view taken along the axis of a preferred casting furnace 10 according to the present invention. The term "axis" or "furnace axis" as used herein refers to the direction in which molten magnesium flows through the furnace. The term "magnesium" as used herein includes pure magnesium and magnesium alloys.

Furnace 10 comprises a rectangular body 12 with an outer steel casing 14 having a refractory lining 16 on its vertically extending side walls 18, end walls 19 and horizontally extending bottom wall 20. Preferably, the furnace 10 has a holding capacity of about 12 to 15 tons of magnesium. By way of example, furnace body 12 may have a width of from about 2 to 2.3 m measured between side walls 18, a height of from about 2.4 to about 2.7 m from bottom wall 20 to the tops of side walls 18, and a length of from about 3.6 to about 4.8 m measured between end walls 19 along the furnace axis.

The furnace 10 is provided with a vertical weir 22 dividing the furnace body 12 into two compartments, a feed compartment 24 into which molten magnesium is introduced and an extraction compartment 26 from which the molten magnesium is removed for casting. Although the preferred furnace 10 according to the invention includes one vertical weir 22, it will be appreciated that more than one vertical weir 22 may be provided so as to divide the rectangular furnace body 12 into more than two consecutive compartments, with molten magnesium being introduced into the first compartment and being removed from the last compartment.

Inside each compartment 24, 26, molten magnesium is maintained in contact with a liquid heating medium. The liquid heating medium is preferably a molten salt of the type used in electrolytic cells for magnesium production. The molten salt may preferably be a mixture of sodium chloride, potassium chloride, calcium chloride and calcium fluoride, and has a density greater than that of the molten magnesium. Therefore, two layers are formed in compartments 24, 26, an upper layer 28 consisting of molten magnesium and a lower layer 30 consisting of the liquid heating medium. The two layers 28 and 30 are separated by an interface 32.

The furnace body 12 is provided with heating means to maintain the liquid heating medium 30 and the molten magnesium in a liquid state. Preferably, the heating means comprises a set of electrodes 34 installed in the side walls 18 or end walls 19 of furnace body 12, the electrodes 34 being in contact with the molten salt layer 30.

The vertical weir 22 is comprised of a refractory material, extending between and connected to two opposing side walls 18 of the rectangular furnace body 12. The vertical weir has a top 36 which is situated below a maximum level 38 and a minimum level 39 of the magnesium layer 28. The quantity of magnesium above the top 36 of weir 22 is maintained between levels 38 and 39 during casting and represents the buffer capacity of the furnace 10. For example, the maximum magnesium level 38 may be from about 700 to about 800 mm above the top 36 of weir 22 and about 200 mm below the tops of side walls 18. The minimum level 39 may be from about 350 to about 450 mm above the top 36 of weir 22.

The bottom 40 of weir 22 is situated below magnesium/salt interface 32, with an opening 42 being provided between the bottom 40 of vertical weir 22 and the bottom wall 20 of the rectangular furnace body 12. In one preferred embodiment, the opening 42 extends across the width of the rectangular furnace body 12 between side walls 18, and the bottom 40 of vertical weir 22 is arched-shaped so that opening 42 is higher in the middle of furnace body 12 than at the side walls 18. The opening 42 provides communication between the molten salt layers 30 in the compartments 24, 26, permitting circulation of the molten salt between compartments 24, 26 to provide even heating and to maintain the interface 32 at the same level throughout the furnace compartments 24, 26. In one example, the maximum height of opening 42 is from about 500 to about 600 mm, with the minimum spacing between interface 32 and the bottom 40 of weir being about 200 mm.

Preferably, the vertical weir 22 is free of openings between the top 36 and the interface 32 to thereby force the molten magnesium to flow over the top 36 from feed compartment 24 to extraction compartment 26. As illustrated in the drawings, the vertical weir 22 is more preferably free of openings between its bottom 40 and its top 36, and is substantially perpendicular to the furnace axis.

The molten magnesium is charged into the feed compartment 24 through a charging pipe 44 which preferably extends down through the top of furnace 10 into an area of compartment 24 which is remote from weir 22. Pipe 44 is preferably constructed from carbon steel and has a diameter of about 10 inches. The discharge pipe 44 preferably extends substantially vertically downwardly into the magnesium layer 28 such that the discharge end 46 of charging pipe 44 is below the top 36 of vertical weir 22 and above the interface 32. In one preferred example, the discharge end 46 of pipe 44 is spaced from about 200 to about 300 mm above the interface 32.

The discharge end 46 of charging pipe 44 is provided with means for redirecting the magnesium so that, as it exits the downwardly extending discharge pipe 44, it is directed parallel to the interface 32 between the molten magnesium 28 and the molten salt 30 layers. Preferably, the redirecting means changes the direction of the flow of magnesium from a substantially downward vertical direction to a substantially horizontal direction. This redirection of the molten magnesium minimizes downward flow of the magnesium 28 toward the salt layer 30, minimizing intermixing of the magnesium and salt layers 28 and 30.

Preferably, the redirecting means comprises a plate 48 provided at the discharge end 46 of charging pipe 44, the plate 48 being spaced from the discharge end 46 of charging pipe 44, and also spaced above the magnesium/salt interface 32. The plate 48 is preferably spaced from about 100 to about 150 mm from both the interface 32 and the discharge end 46 of pipe 44. As shown in the drawings, plate 48 is preferably horizontal and substantially parallel to the magnesium/salt interface, so as to direct the magnesium exiting charging pipe 44 in a substantially horizontal direction. In the preferred embodiment shown in the drawings, the plate 48 has dimensions which are substantially the same as the diameter of the discharge end 46 of pipe 44. For example, the plate 48 may be a 10 inch diameter circular plate. The plate 48 is preferably mounted to the discharge end 46 of pipe 44 by a mounting bracket or rod 50.

Although the preferred redirecting means comprises a plate 48, it will be appreciated that other types of redirecting means may be employed. For example, the discharge end 46 of pipe 44 may be provided with a 90 degree elbow which directs the magnesium toward the weir 22 parallel to interface 32. One advantage of utilizing a plate 48 having the same dimensions and shape as the pipe 44 is that the pipe 44 can be withdrawn upwardly through the cover in which it is installed in the furnace 10. This is desirable during periodic replacement of the pipe 44 due to corrosion which occurs at the magnesium/air interface. The pipe typically must be replaced every two months.

The preferred furnace 10 according to the invention is also provided with a partition wall 52 which is located upstream of the vertical weir 22 and which forms a back wall of the feed compartment 24. The partition wall 52 is provided to form a compartment 53 containing molten salt and being substantially free of molten magnesium. The approximate level of molten salt in compartment 53 is indicated by reference numeral 55, typically being lower than the maximum level 38 of magnesium in compartments 24 and 26, and higher than the magnesium/salt interface 32. One purpose of compartment 53 is for heating tools and equipment prior to insertion into the furnace 10. Another purpose is to limit fluctuation of the interface 32 during removal of molten metal from extraction compartment 26. Specifically, as metal is removed from compartment 26, the salt level in compartment 53 drops, thereby pushing up interface 32 and tending to minimize fluctuation in the level of magnesium layer 28.

The partition wall 52 has a top 54 which extends above the maximum level 38 of the molten magnesium layer 28, to thereby prevent flow of magnesium into salt compartment 53, and has a bottom 56 which extends below the magnesium/salt interface 32. Partition wall 52 is free of openings between its top 54 and interface 32, and extends continuously between side walls 18 so as to prevent magnesium 28 from entering the salt compartment 53. However, an opening 58 is provided between the bottom 56 of partition wall 52 and the bottom wall 20 of furnace body 12, so as to allow circulation of molten salt into and out of the accumulation compartment 53. Preferably, as with vertical weir 22, the opening 58 extends across the full width of furnace body 12 between side walls 18, and the bottom 56 of partition wall 52 is preferably arch-shaped so that the opening 58 is higher in the middle of furnace body 12 than at the side walls 18. The dimensions of opening 56 are preferably about the same as the dimensions of opening 42 below weir 22.

The furnace body 12 is provided with a thermally insulated lid 60 extending over all of the compartments 24, 26 and 53. Each compartment is provided with a removable access cover 62, 64, 66. Access into feed compartment 24 is provided through cover 64 so as to allow occasional cleaning of compartment 24. Preferably, charging pipe 44 extends through an aperture in cover 64. Access to extraction compartment 26 is provided by cover 66, which is removed during installation of transfer pump 68 which removes magnesium from the extraction compartment 26 and transfers it to a casting line. Access to salt compartment 53 is provided by cover 62 which is removed to allow insertion of tools or other equipment into compartment 53.

The continuous casting of magnesium takes place in the manner described below.

The furnace 10 is charged with molten salts 30 of the type which are used in electrolytic cells for magnesium production, and are maintained in a molten state by electrodes 34. The covers 62, 64 and 66 in the furnace lid 60 are closed and a protective gas is supplied to the furnace by a gas conduit (not shown). After a batch of magnesium has been prepared in an alloy preparation furnace (not shown), the molten metal is transferred by a pump (not shown) from the alloy preparation furnace, through charging pipe 44 and into the feed compartment 24 of furnace 10. Initial charging of the molten magnesium is continued until the magnesium level in the furnace 10 is at or close to the maximum level 38. This may require the addition of several batches of alloy, since alloy is typically prepared in 3 ton batches and the capacity of the furnace 10 is about 12 to 15 tons. As the magnesium fills compartments 24, 26, the amount of molten salt in compartments 24, 26 gradually diminishes and fills the accumulation compartment 53, which always contains only molten salt and substantially no magnesium.

The charging of molten magnesium into feed compartment 24 through charging pipe 44 creates turbulence in compartment 24. After the magnesium is charged into feed compartment 24 and directed horizontally along the magnesium/salt interface 32, it flows over the top 36 of weir 22 into the extraction compartment 26 from where it is continuously transferred to the casting line by pump 68. Since the feed compartment 24 is separated from the extraction compartment 26 by weir 22, any turbulence created in the feed compartment 24 by the charging of the magnesium does not affect the magnesium in extraction compartment 26, resulting in castings of high quality.

As the molten metal is removed from extraction chamber 26 by transfer pump 68, the level of magnesium will drop towards the minimum acceptable level 39. When the magnesium reaches minimum level 39, a new batch of alloy is added, thereby providing continuous operation of the casting furnace. The preferred furnace 10 described above can supply magnesium to a casting line at a rate of about 3 to 4 tons per hour, with the average residence time of the magnesium inside furnace 10 being about 1 hour.

Although the invention has been described in connection with certain preferred embodiments, it is to be understood that it is not limited thereto. Rather, the invention includes all embodiments which may fall within the scope of the following claims.

What is claimed is:

1. A casting furnace for continuous casting of molten magnesium in which a layer of said molten magnesium is maintained in contact with a layer of a liquid heating medium having greater density than said molten magnesium, said casting furnace comprising:

a furnace body for containing said molten magnesium and said liquid heating medium, said furnace body having side walls and a bottom wall, with inner surfaces of said walls having a refractory lining;

at least one vertical weir extending between two of said side walls and dividing said furnace body into a plurality of compartments, said plurality of compartments including a feed compartment into which said molten magnesium is introduced and an extraction compartment from which said molten magnesium is removed for casting, said at least one vertical weir having a top which is situated below a maximum level of said molten magnesium and a bottom which is situated below an interface between the molten magnesium and the heating medium, with an opening being provided between the bottom of the at least one vertical weir and the bottom wall of the furnace body, said at least one vertical weir being free of openings between its top and the interface;

a charging pipe through which magnesium is introduced into said feed compartment, said charging pipe having a discharge end which is located below the top of the at least one vertical weir and above the interface between the molten magnesium and the heating medium;

magnesium redirection means provided at the discharge end of the charging pipe, said redirection means having a redirecting portion extending substantially parallel to the interface and spaced therefrom so as to direct said molten magnesium along the interface; and heating means to maintain said liquid heating medium and said molten magnesium in a liquid state.

2. A casting furnace as claimed in claim 1 comprising one said vertical weir, said weir separating said feed compartment from said extraction compartment.

3. A casting furnace as claimed in claim 1, wherein said redirecting portion of said magnesium redirection means is positioned horizontally and substantially parallel to the interface between the molten magnesium and the heating medium.

4. A casting furnace as claimed in claim 1, wherein said magnesium redirection means comprises a plate spaced from the discharge end of the charging pipe.

5. A casting furnace as claimed in claim 4, wherein said plate is positioned horizontally and substantially parallel to the interface between the molten magnesium and the heating medium.

6. A casting furnace as claimed in claim 5, wherein said plate has dimensions which are substantially the same as the diameter of the discharge end of the discharge pipe.

7. A casting furnace as claimed in claim 6, said magnesium redirection means additionally comprising a mounting bracket by which the plate is connected to the charging pipe.

8. A casting furnace as claimed in claim 1, wherein said furnace body has a top comprised of a refractory material, said top including removable covers to provide access to said plurality of compartments.

9. A casting furnace as claimed in claim 1, wherein said opening in the bottom of the vertical weir is arch-shaped.

10. A casting furnace as claimed in claim 1, wherein said at least one vertical weir is free of openings between its bottom and its top.

11. A casting furnace as claimed in claim 1, wherein said at least one vertical weir is substantially perpendicular to a furnace axis.

12. A casting furnace as claimed in claim 1, further comprising a partition wall located upstream of the at least one vertical weir, said partition wall having a top which is situated above the maximum level of said molten magnesium and a bottom which is situated below the interface between the molten magnesium and the heating medium, with an opening being provided between the bottom of the partition wall and the bottom wall of the furnace body, said partition wall being free of openings between its top and the interface, said partition wall forming a liquid heating medium compartment which is substantially free of said molten magnesium.

13. A casting furnace as claimed in claim 1, wherein said heating means comprises a set of electrodes which are in contact with said layer of liquid heating medium.

14. A method for continuous casting of molten magnesium, comprising:

charging said molten magnesium through a charging pipe into a feed compartment of a casting furnace in which a layer of said molten magnesium is maintained in contact with a layer of a liquid heating medium having greater density than said molten magnesium, said molten magnesium being introduced into said feed compartment above an interface between the molten magnesium and the liquid heating medium;

as the molten magnesium is introduced into the feed compartment, directing it parallel to the interface toward a vertical weir dividing said feed compartment from an extraction compartment of the casting furnace, said vertical weir having a top which is situated below a maximum level of said molten magnesium and a bottom which is situated below the interface between the molten magnesium and the heating medium;

withdrawing said molten magnesium from said extraction compartment.

* * * * *